US009706289B2

(12) United States Patent
Adamson et al.

(10) Patent No.: US 9,706,289 B2
(45) Date of Patent: Jul. 11, 2017

(54) LOUDSPEAKER WITH IMPROVED DIRECTIONAL BEHAVIOR AND REDUCTION OF ACOUSTICAL INTERFERENCE

(71) Applicant: ADAMSON SYSTEMS ENGINEERING INC., Port Perry (CA)

(72) Inventors: Alan Brock Adamson, Greenbank (CA); Ben Cabot, Brooklin (CA); Douglas Campbell, Claremont, CA (US)

(73) Assignee: ADAMSON SYSTEMS ENGINEERING INC., Port Perry, ON (CA)

( * ) Notice: Subject to any disclaimer, the term of this patent is extended or adjusted under 35 U.S.C. 154(b) by 0 days.

(21) Appl. No.: 14/840,275

(22) Filed: Aug. 31, 2015

(65) Prior Publication Data

US 2016/0073195 A1 Mar. 10, 2016

Related U.S. Application Data

(60) Provisional application No. 62/047,501, filed on Sep. 8, 2014.

(51) Int. Cl.

| | |
|---|---|
| ***H04R 1/02*** | (2006.01) |
| ***H04R 1/26*** | (2006.01) |
| ***H04R 3/14*** | (2006.01) |
| *G10K 13/00* | (2006.01) |
| *H04R 1/30* | (2006.01) |
| *H04R 27/00* | (2006.01) |

(52) U.S. Cl.

CPC ..... *H04R 1/26* (2013.01); *H04R 3/14* (2013.01); *H04R 1/30* (2013.01); *H04R 27/00* (2013.01); *H04R 2201/34* (2013.01)

(58) Field of Classification Search

CPC ... H04R 1/26; H04R 1/30; H04R 3/14; H04R 27/00; H04R 2201/34; H04R 1/345

USPC ..... 381/337–340, 345; 181/159, 182, 185, 181/144, 148, 152, 160

See application file for complete search history.

(56) References Cited

U.S. PATENT DOCUMENTS

| | | | | |
|---|---|---|---|---|
| 5,900,593 | A | 5/1999 | Adamson | |
| 6,118,883 | A * | 9/2000 | Rocha | H04R 1/24 181/144 |
| 6,343,133 | B1 | 1/2002 | Adamson | |
| 6,581,719 | B2 | 6/2003 | Adamson | |
| 6,628,796 | B2 | 9/2003 | Adamson | |
| 7,177,437 | B1 * | 2/2007 | Adams | H04R 1/403 381/337 |
| 2009/0214067 | A1 | 8/2009 | Bothe | |
| 2011/0274306 | A1 | 11/2011 | Adams | |

FOREIGN PATENT DOCUMENTS

| | | |
|---|---|---|
| EP | 1178702 | 2/2002 |
| JP | 04167697 | 6/1992 |
| WO | 9314606 | 7/1993 |
| WO | 2012168849 | 12/2012 |

* cited by examiner

*Primary Examiner* — Sunita Joshi

(74) *Attorney, Agent, or Firm* — Lynn C. Schumacher; Stephen W. Leonard; Hill & Schumacher

(57) ABSTRACT

Loudspeaker systems and assemblies are provided in which mid-frequency producing drivers are provided on opposing sides of a high frequency source comprising a linear high-frequency source connected to a waveguide. Crossover circuitry is provided such that the acoustic output from the mid-frequency drivers overlaps with that of the high-frequency source over an intermediate frequency range associated with acoustic interference between the mid-frequency producing drivers. In some embodiments, the mid-frequency producing drivers are recessed behind the output of the waveguide, and optionally angled outwardly from the waveguide, in order decrease the distance therebetween.

21 Claims, 15 Drawing Sheets

SECTION A-A

LOUDSPEAKER WITH IMPROVED DIRECTIONAL BEHAVIOR AND REDUCTION OF ACOUSTICAL INTERFERENCE

CROSS-REFERENCE TO RELATED APPLICATION

This application claims priority to U.S. Provisional Application No. 62/047,501, titled "LOUDSPEAKER WITH IMPROVED DIRECTIONAL BEHAVIOR AND REDUCTION OF ACOUSTICAL INTERFERENCE" and filed on Sep. 8, 2014, the entire contents of which is incorporated herein by reference.

BACKGROUND

The present disclosure relates loudspeakers and audio systems.

Large and small arrays of wide-bandwidth loudspeakers have been the standard for producing medium and high sound pressure levels for communications, presentations, concerts and performances demanding high fidelity for many years. Both large and small sound systems for commercial uses are found in movie theatres, board rooms, universities, night clubs, race tracks, stadiums and houses of worship—to name but a few applications. Such systems are commonly used to amplify an audio signal derived from a live or a recorded source that is controlled by an operator using an audio mixing system called an audio mixing console. The console is followed by a wide array of electronic equipment that results in the amplified audio signals radiating from arrays of loudspeakers directed toward an audience.

Early in the history of professional audio, two distinct loudspeaker types have been evident that are of interest. The most common has been a multi-way loudspeaker characterized by transducers of different frequency band assembled in a common enclosure. The second is the line array or column loudspeaker, characterized as a group of limited bandwidth transducers of a common frequency range, arrayed in a straight line in a long narrow enclosure. Engineers have utilized both types of loudspeaker types in several fundamentally different approaches to sound dispersion in larger applications, with the common goal of delivering sound more uniformly and with greater clarity to the listener. One approach has been to use a concentrated three dimensional group of loudspeakers, known alternately as a spherical array, a cluster or perhaps a point source. Where projecting sound from such a source is not feasible, another approach has been to distribute loudspeakers throughout the listening space.

In the past two decades, the principles of the simple line array have been more widely applied resulting in new variants of the two-way and three-way loudspeaker. In the example of the two-way loudspeaker, vertical arrays of enclosures have been configured to align vertical rows of low-frequency transducers symmetrically on either side of a centrally oriented high-frequency linear sound source. For the best performance, the high-frequency (HF) source is typically very narrow in the horizontal dimension and the vertical dimension ideally extends to the full height of the loudspeaker enclosure.

SUMMARY

Loudspeaker systems and assemblies are provided in which mid-frequency producing drivers are provided on opposing sides of a high frequency source comprising a linear high-frequency source connected to a waveguide. Crossover circuitry is provided such that the acoustic output from the mid-frequency drivers overlaps with that of the high-frequency source over an intermediate frequency range associated with acoustic interference between the mid-frequency producing drivers. In some embodiments, the mid-frequency producing drivers are recessed behind the output of the waveguide, and optionally angled outwardly from the waveguide, in order decrease the distance therebetween.

In a first aspect, there is provided a loudspeaker system comprising:

a linear acoustic source;

a waveguide configured to radiate the sound energy from said linear acoustic source, said waveguide having a proximal aperture for receiving sound energy and a distal aperture for radiating sound energy and a surface therebetween for controlling horizontal dispersion of the sound energy emitted therefrom;

a first driver and a second driver provided on opposing sides of a central plane bisecting said distal aperture of said waveguide;

signal processing circuitry comprising crossover circuitry that is configured to split an input signal into a first signal within a first frequency range and a second signal within a second frequency range, wherein the second frequency range is lower than the first frequency range and overlaps with the first frequency range over an intermediate frequency range, and wherein said crossover circuitry is in electrical communication with said linear acoustic source and said first driver and said second driver for providing the first signal to said linear acoustic source, and providing the second signal to said first driver and said second driver;

wherein said first driver and said second driver are provided with a relative spacing such that acoustic interference between said first driver and said second driver occurs within the intermediate frequency range, such that the acoustic interference is suppressed at least in part within the intermediate frequency range by the sound energy emitted by the waveguide.

In another aspect, there is provided a loudspeaker assembly comprising:

a linear acoustic source configured to output sound energy within a first frequency range;

a waveguide configured to receive the sound energy from said linear acoustic source, said waveguide having a distal aperture for controlling horizontal dispersion of the sound energy emitted therefrom;

a driver provided on one side of a central plane bisecting said distal aperture of said waveguide;

wherein said driver is configured to operate within a second frequency range that is lower than the first frequency range and overlaps with the first frequency range over an intermediate frequency range; and wherein said driver is recessed behind said distal aperture of said waveguide; and wherein said driver is angled outwardly relative to said central plane.

In another aspect, there is provided a loudspeaker system comprising:

a loudspeaker assembly as described above; and crossover circuitry configured to split an input signal into a first signal within the first frequency range and a second signal within the second frequency range; and signal processing circuitry configured to control a time delay between the first signal and the second signal to reduce the additional acoustic interference due to pressure caused by the output of the driver.

In another aspect, there is provided a loudspeaker assembly comprising:

a linear acoustic source configured to output sound energy within a first frequency range;

a waveguide configured to receive the sound energy from said linear acoustic source, said waveguide having a distal aperture for controlling horizontal dispersion of the sound energy emitted therefrom;

a first driver and a second driver provided on opposing sides of a central plane bisecting said distal aperture of said waveguide;

wherein said first driver and said second driver are configured to operate within a second frequency range that is lower than the first frequency range and overlaps with the first frequency range over an intermediate frequency range;

wherein said first driver and said second driver are provided with a relative spacing such that acoustic interference between said first speaker driver and said second driver occurs within the first frequency range;

wherein said first driver and said second driver are recessed behind said distal aperture of said waveguide; and wherein said first driver and said second driver are angled outwardly relative to said central plane.

A further understanding of the functional and advantageous aspects of the disclosure can be realized by reference to the following detailed description and drawings.

BRIEF DESCRIPTION OF THE DRAWINGS

Embodiments will now be described, by way of example only, with reference to the drawings, in which.

DETAILED DESCRIPTION

Figure 1A:
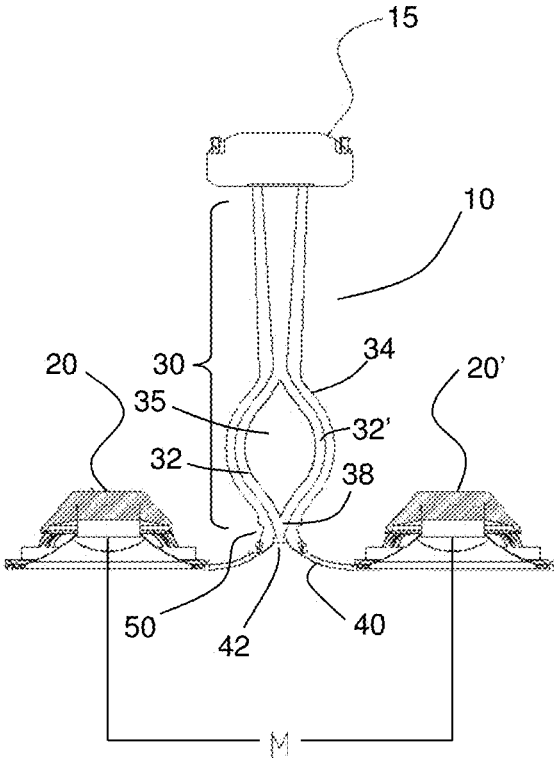
FIGS. 1A and 1B show top and front views of an example embodiment of a two-way loudspeaker including a high-frequency linear source coupled to a waveguide.

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms "comprises" and "comprising" are to be construed as being inclusive and open ended, and not exclusive. Specifically, when used in the specification and claims, the terms "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. Unless otherwise specified, the terms "about" and "approximately" mean plus or minus 25 percent or less.

It is to be understood that unless otherwise specified, any specified range or group is as a shorthand way of referring to each and every member of a range or group individually, as well as each and every possible sub-range or sub-group encompassed therein and similarly with respect to any sub-ranges or sub-groups therein. Unless otherwise specified, the present disclosure relates to and explicitly incorporates each and every specific member and combination of sub-ranges or sub-groups.

As used herein, the term "on the order of", when used in conjunction with a quantity or parameter, refers to a range spanning approximately one tenth to ten times the stated quantity or parameter.

Unless defined otherwise, all technical and scientific terms used herein are intended to have the same meaning as commonly understood to one of ordinary skill in the art. Unless otherwise indicated, such as through context, as used herein, the following terms are intended to have the following meanings:

As used herein, the phrase "high-frequency driver" refers to an acoustic transducer producing sound energy having a frequency range that includes, but is not limited to, frequencies with the range of 1000 Hz to 15000 Hz. In many of the embodiments described herein, a "high-frequency source" or "high-frequency driver" also produces mid-frequency sound energy, to achieve frequency overlap with mid-frequency producing drivers over an intermediate frequency range.

As used herein, the phrase "mid-frequency producing driver" refers to a transducer that produces sound energy having a frequency range that includes, but is not limited to, frequencies with the range of 200 Hz to 1000 Hz.

As used herein, the phrase "low-frequency driver" refers to a transducer producing sound energy having frequency range that includes, but is not limited to, frequencies with the range of 80 Hz to 250 Hz.

The phrase "linear source", as used herein, refers to a source of sound energy having an output forming a narrow linear strip or directed through a narrow linear aperture. A linear source may be produced by one or more high-frequency transducers. In one non-limiting example, a linear source may be produced by a driver (for example, a compression driver) interfaced with a sound chamber having an output aperture forming a slot. In another example embodiment, a linear source may be formed from a vertical row of small diameter tweeters. According to various embodiments of the present disclosure, a linear source is connected to a waveguide for controlling for controlling horizontal dispersion or directivity.

Figure 1B:
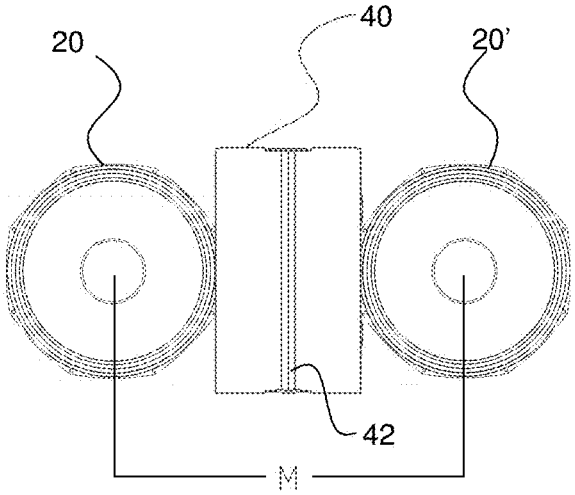

Referring to FIGS. 1A and 1B, an example embodiment is provided illustrating a symmetrical two-way loudspeaker configuration, in which a pair of mid-frequency producing drivers 20 and 20' (e.g. dynamic drivers; woofers) is provided on either side of a linear high-frequency source 10 that is coupled to a waveguide 40. The mid-frequency producing drivers can also produce low-frequency sound energy, but need not produce low-frequency sound if additional lateral low-frequency drivers are provided, as described in additional example embodiments provided below.

Such a system is suitable for use as a loudspeaker array element of a loudspeaker array, commonly referred to as a line array. This type of system is often described as possessing coplanar symmetry, since the mid-frequency producing drivers 20 and 20' are arranged in mirror image pairs on either side of the plane at the centerline of high-frequency linear source 10. This symmetrical driver arrangement results in a natural symmetry in the horizontal dispersion of sound from the line array. As described below, single-woofer variations of such a configuration also exist, but they do not take advantage of symmetry.

In the example embodiment shown in FIG. 1, the high-frequency driver 15 is affixed (or otherwise connected) to a sound chamber 30 that is provided for shaping the wavefront emitted by the high-frequency driver. Sound chamber 30 is typically disposed in the center of the loudspeaker enclosure and defines, at its exit 38, a high-frequency line source which, in an optimal design, extends from the top to the bottom of the enclosure. In this embodiment, output 38 of sound chamber 35 is a narrow slot having uniform width and is slightly curved outwardly from the enclosure; the angle of the arc is roughly equal to the included angle of the top and bottom of the loudspeaker enclosure. In the example embodiment shown in FIG. 1A, the high frequency source 15 is a high-frequency compression driver suited to the reproduction of high frequencies.

Sound chamber 30 is a wave-shaping chamber that transforms the circular planar wave front at the exit of the high frequency source 15 into a planar or slightly curved ribbon shaped wave front. If the flatness of the high frequency wave front can be sacrificed, a simple diffraction horn with a narrow exit dimension can be used, as described further below.

As can be seen from FIG. 1A, the transformation of the wave front within sound chamber 38 is achieved by creating a plurality of paths 32 and 32' between a shell 34 and an inner body 36 and/or through discrete passage ways. The resulting wave front usually exits from a narrow slot 38 or linear exit. In order to ensure high-frequency dispersion, the slot is generally quite narrow, forming a neck 50 as seen in a horizontal cross section of the sound chamber, and is often the narrowest part of the sound chamber and overall high-frequency driver assembly. The narrow, linear exit 38 of sound chamber 38, combined with the similarly shaped entrance of waveguide 42, forms neck 50, defining a narrowing or pinched location of the high-frequency assembly.

As shown in FIG. 1A, output 38 of sound chamber 30 is followed by (acoustically coupled) a waveguide 40 that is used to control the dispersion of the sound chamber in the direction that is perpendicular to the slot narrow output aperture 42 of waveguide 40. Such a direction will henceforth be referred to as a horizontal direction, as the waveguide output itself is conventionally oriented in a direction within the vertical plane. However, it will be understood that the terms "horizontal" and "vertical" are not intended to be limiting, and more generally imply a pair of orthogonal directions.

Waveguide 40 may be formed, for example, as an extended outer shell as shown in FIG. 1A, or alternatively by the wooden surfaces of the loudspeaker enclosure as taught by Heil and others. The inner surface of waveguide 40, upon which high-frequency sound energy emitted by sound chamber 30 impinges, is shaped according to a mathematically correct profile that facilitates greater control of the shaped surface of the waveguide from the exit of the sound chamber to the termination of the waveguide, thereby achieving a controlled dispersion of the high-frequency sound energy in the horizontal plane.

It is noted that the expression "acoustic waveguide" has been used by Geddes and Adamson since the mid 1980's to describe particular horn like structures based on specific mathematical coordinate systems. This family of waveguides was conceived by Geddes to reduce to a minimum or eliminate altogether, the interference with a wavefront which occurs at the boundary formed by the waveguide. This was achieved by maintaining the angle of the waveguide boundary normal to the wavefront so that no energy would be reflected away from the boundary. A waveguide based on the oblate spheroidal coordinate system was brought to market by Adamson in 1987.

It is also noted that, following this specific application of the term "waveguide", Heil introduced the "guide d'onde" in his French patent filing, which was translated in his US filing as "wave guide". However, it is to be understood that this arbitrary shape has an entirely different purpose and can take many dimensional forms. Generally speaking the purpose of the Heil "wave guide" is to convert a wave front shaped like a flat disc or a partial sphere at the exit of a high-frequency compression driver, into a flat ribbon shaped wave front that, according to Heil, forms a cylindrical wave front. In order to differentiate between the two devices, the expression "sound chamber" or "wave shaping sound chamber" is used herein to describe its devices used for this purpose.

Although sound chamber 30 is shown as interfacing with a single high-frequency driver, it will be understood that more complex configurations may be employed. For example, U.S. Pat. No. 6,343,133, titled "Axially Propagating Mid and High Frequency Loudspeaker Systems" describes a co-linear sound chamber creating two parallel mid-range slots on either side of the high-frequency slot in order to further improve the coherence of the midrange section of the line array. In this example, the high-frequency and mid-frequency slots are energized by a co-axial mid and high range transducers placed at the entrance of the sound chamber. The slots are flanked by a pair of woofers. This configuration involves the application of particular signal conditioning, either active or passive, in order to merge the acoustical outputs of the two mid-frequency slots with the one high-frequency slot.

In the two-way configuration shown in FIGS. 1A and 1B, the mid-frequency producing drivers are relied upon to provide mid-range frequencies. When this simpler two-way loudspeaker is considered, it becomes clear that the size of the mid-frequency producing drivers will be limited. For example, many successful two-way loudspeaker line arrays are found based on 8" and smaller diameter woofers, whereas two-way 10" line arrays are less common. Indeed, in the symmetrical configuration shown, there are several interrelated limiting factors that dominate the physical design. The first consideration is often the distance between the acoustic or physical centers of the pair of mid-frequency producing drivers. This factor is controlled by the width of the waveguide and the diameter of the chosen mid-frequency producing drivers with respect to the mid-range frequencies thereby reproduced.

This can be understood by referring again to FIGS. 1A and 1B, where it can be seen that the distance "M" between the mid-frequency producing drivers 20 and 20' on either side of the waveguide 40 should be minimized, in order to reduce acoustical interference caused by the overlapping of the two common mid-frequency wavefronts. This problem is illustrated in FIG. 10, in which the mid-frequency sound energy is shown emitted along different directions from mid-frequency producing drivers 20 and 20'. Shown in the figure are two different propagation paths associated with wavefronts propagating from the two mid-frequency producing drivers 20 and 20'. Propagation paths 105 and 110 have an equal length L, and therefore result in constructive interference at point 115. However, propagation paths 120 and 125 differ by one half of a wavelength, and therefore destructive interference occurs at point 130.

Moreover, in consideration of a design based on an 800 Hz crossover between the low-frequency and high-frequency drivers, Commonly in loudspeaker design the width of the waveguide mouth should be ½ of the desired frequency cut-off ((344 m/s/800 Hz)/2)=0.2150 m wide. The placement of 2×10" (0.254 m) drivers located on either side of the horn will result in a distance between the acoustic centers of the two sources of the mid-frequency producing driver is ((0.254 m/2)*2)+0.2150 m)=0.469 m.

Olson further teaches that the distance between the two sources should be less than a half of a wavelength at the highest operating frequency. Following this rule, one would find a maximum operating frequency of (344 m/s/(0.3615 m*2))=475 Hz. Considering that the desired operating cut off frequency of the high-frequency driver is 800 Hz, the design requirement is not achieved.

Due to this limitation, a noticeable feature of various 10" line arrays is that the woofer is generally not simply placed on either side of the high-frequency source. In some loudspeakers, a plurality of vertical vanes is placed in front of the woofers. In other designs, the woofers are rotated to an extreme angle and placed in pockets. In still other designs, the waveguide exit is truncated, forgoing the superior directivity control offered by others.

The interference problem can also be avoided by selecting mid-frequency producing drivers that have a small size, such that the inter-driver distance M is sufficiently small to push the interference points beyond the specified angular operating bandwidth of the loudspeaker system over the frequency range of interest. Furthermore, the interference problem can be avoided by selecting an operating bandwidth of the mid-frequency producing drivers to avoid mid-range frequencies for which the interference problem is more pronounced. These solutions, however, place significant constraints on the size and/or frequency range of the drivers, substantially limiting performance and functionality. Another avenue for avoiding the interference problem is to employ a three-way loudspeaker, since the smaller diameter mid-range speakers will naturally result in a shorter center to center distance, and the outer low-frequency producing drivers will not be susceptible to interference due to their inherently low frequency range. By employing mid-range drivers in the order of 6" diameter, a reasonably coherent common midrange wave front can result from this arrangement.

In contrast to these prior approaches to avoiding the effects of interference between the mid-frequency producing drivers, one example embodiment of the present disclosure involves controlling the mid-frequency producing drivers 20 and 20' and the high frequency source 10 such sound energy is produced by the mid-frequency drivers 20 and 20' and by the high-frequency source 10 within an overlapping intermediate frequency range, where the intermediate frequency range includes the frequencies at which acoustic interference between the mid frequency drivers 20 and 20' occurs (as per the relative spacing between the mid-frequency drivers 20 and 20'). In other words, the crossover circuitry, which determines the first frequency range in which the high-frequency source produces sound energy, and which also determines the second frequency range over which the mid-frequency producing drivers 20 and 20' produce sound energy, is configured such that the high frequency source 10 produces sound energy within the bandwidth of the mid-frequency producing drivers 20 and 20' at frequencies that would be associated with interference between the mid-frequency producing drivers 20 and 20', such that the effects of the acoustic interference can be reduced or suppressed.

Figure 1C:
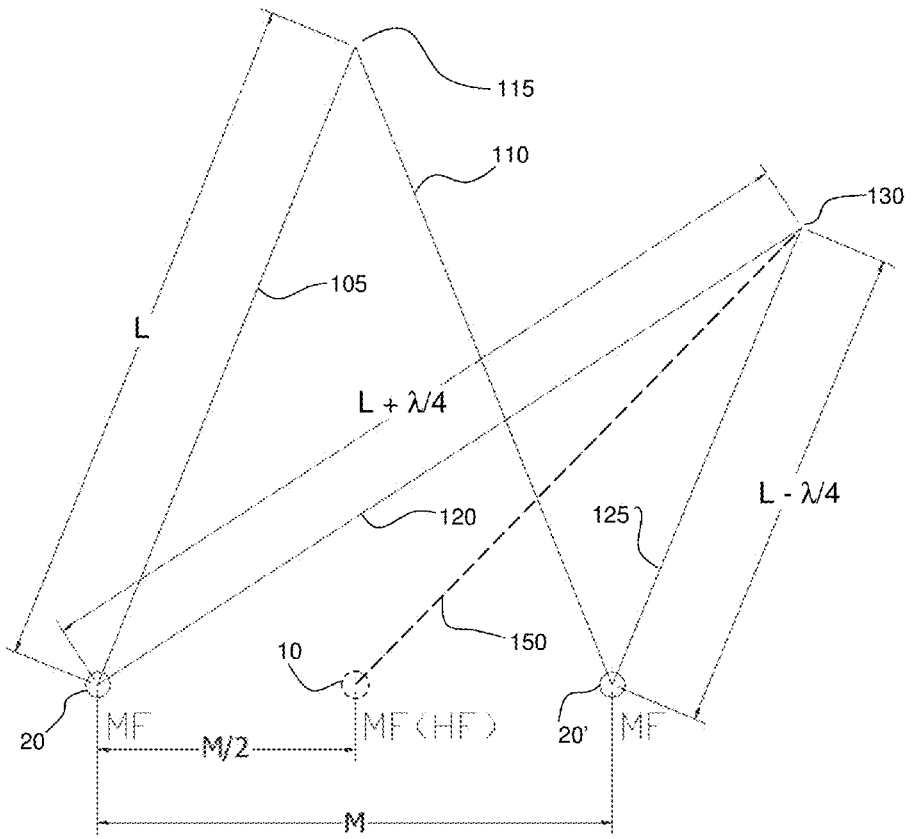
FIG. 1C illustrates the acoustic interference that results from mid-frequency sound energy that is emitted from the two mid-frequency producing drivers.

This example embodiment is illustrated in FIG. 1C, where the high-frequency source 10 is also producing sound energy, the path of which is shown at 150, such that complete destructive interference is avoided at point 130. This leads to a much more homogeneous sound field, effectively smoothing out interference nodes that would have otherwise been produced by mid-frequency producing drivers 20 and 20'.

This method therefore provides improved acoustical performance, both on and off axis in the particular geometric relationship of the transducers and sound chamber(s) within a loudspeaker enclosure, that creates a defined acoustical interference that can be corrected by the frequency overlap of the first frequency range, that being the range in which the high-frequency driver(s) operate, and the second frequency range, in which the mid-frequency producing drivers operate.

Figure 2:
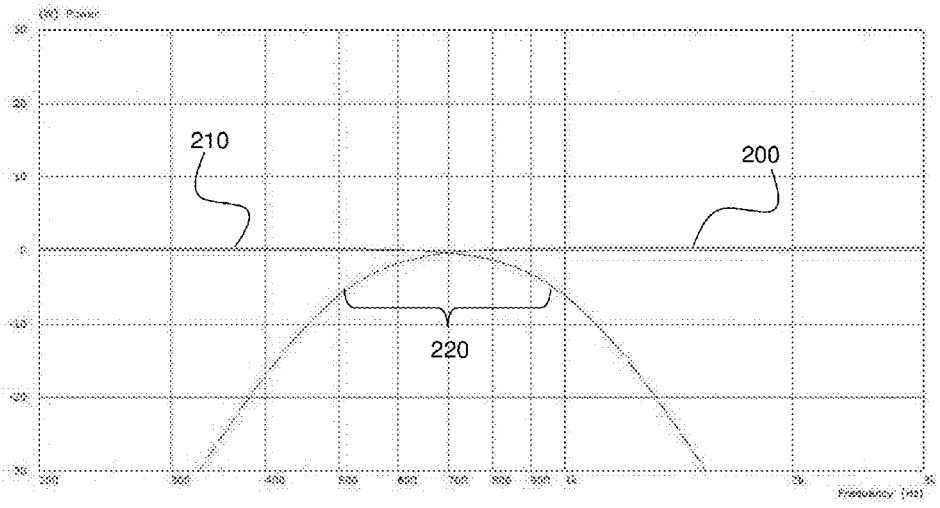
FIG. 2 illustrates example crossover filter profiles for the signals provided to the mid-frequency producing drivers and the high-frequency source.

As noted above, the range of frequencies that may be delivered to the high frequency source and the mid-frequency producing drivers is controlled by suitable crossover circuitry, which may be incorporated into the loudspeaker enclosure, or provided externally. Example filter profiles for use in the crossover defining the first frequency range corresponding to the high frequency source, and the second frequency range corresponding to the mid-range producing drivers, are provided in FIG. 2. An example filter profile for the first frequency range is shown at 200, and an example filter profile for the second frequency range shown at 210, and it can be seen that the two filter profiles overlap (as shown, for example, by the −6 dB range illustrated at 220 in the figure), over a substantial frequency interval.

In the example case shown, the frequency overlap (measured at a −6 dB point) occurs over more than 400 Hz, but it will be understood that the overlap can be selected according to the nature and frequency location of the interference that is to be controlled. In another example implementation, the frequency overlap (measured at a −6 dB point) is greater than 200 Hz. For example, if the goal of the design is to reduce interference produced by the mid-frequency producing drivers that occurs over a range of 500-700 Hz, then the overlap need only be established over this range—in other words, the bandwidth of the high-frequency drivers, as dictated by the crossover, must extend down to this frequency range. It is noted, however, that in additional example embodiments described below, the frequency overlap between the mid-frequency producing drivers and the high-frequency source may be selected (e.g. extended) such that the sound energy from the mid-frequency producing drivers can reduce or suppress interference effects originating by the high-frequency source.

As explained above, the present example system employs mid-frequency producing drivers and (one or more) high-frequency drivers that are driven with a suitable frequency overlap therebetween, where the frequency overlap is employed to reduce the mid-frequency interference by operating the high-frequency driver at frequencies including those where interference of the mid-frequency producing drivers occurs. The operation of all three drivers in tandem means that the effective distance between the sources has been halved. Thus the positions that were previously 100% out of phase now have the third source providing a signal as well, as described with reference to FIG. 1C. The overlap also reduces the problems of acoustic discontinuity of the sound as it exits the waveguide. Having the MF drivers operate at the same frequency as the high-frequency source also benefits in reducing the discontinuities at the frequencies that the waveguide cannot control, as further described below.

As noted above, interference caused by the two mid-frequency transducers is created due to the separation of the two transducers producing the same signal. As shown in FIG. 1C, the interference varies from constructive, when the path difference from one transducer to the other is a multiple of one wavelength, to destructive when the path difference is one a multiple of one wavelength, plus one half wavelength.

The frequency at which the destructive interference occurs at a given angle (or equivalently, the angle (relative to the plane bisecting the waveguide aperture) at which destructive interference occurs at a given frequency) is raised by having the two transducers brought closer together.

Figure 3A:
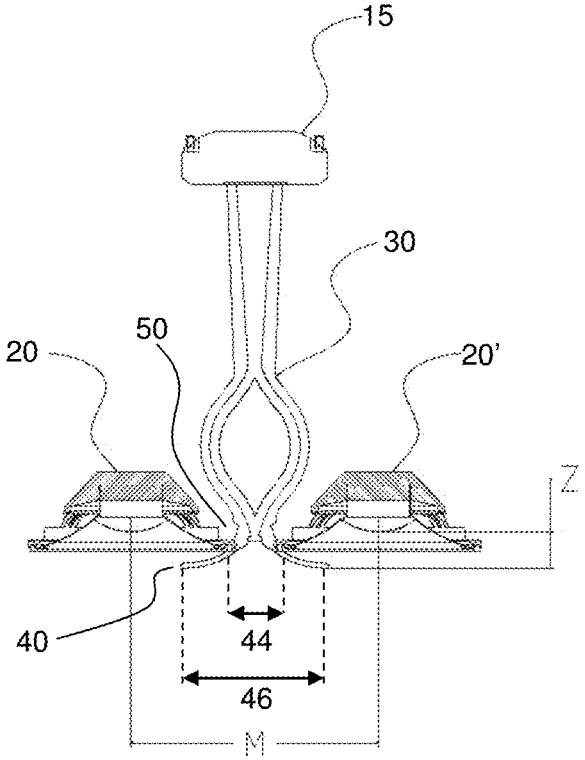
FIGS. 3A and 3B show top and front views of an example embodiment of a two-way loudspeaker including a high-frequency linear source coupled to a waveguide, where the lateral mid-frequency producing drivers are recessed behind the waveguide.
Figure 3B:
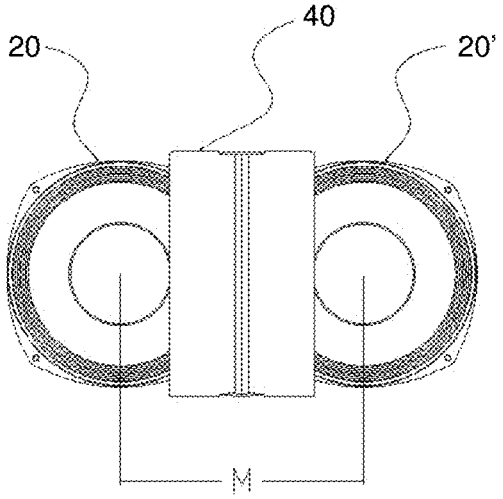

FIGS. 3A-B and FIGS. 4A-B present some example embodiments for increasing the interference frequency at a given angle (or angle at a given frequency). Referring now to FIGS. 3A and 3B, the separation M between the mid-frequency producing drivers 20 and 20' is decreased relative to that shown in FIGS. 1A and 1B by positioning the drivers 20 and 20' behind at least a portion of waveguide 40, such that a minimum distance 44 between the mid-frequency drivers 20 and 20' is less than the width 46 of the outlet of waveguide 40. As shown in FIG. 3A, this is achieved by recessing mid-frequency producing drivers 20 and 20' a distance "Z" behind the outlet of waveguide 40.

In embodiments in which high-frequency linear source 10 includes a sound chamber, neck 50 is visible in the cross section where the wave front enters waveguide 40 from sound chamber 30. The location of neck 50 therefore is associated with the minimum distance by which mid-frequency producing drivers 20 and 20' can be separated. Accordingly, by physically offsetting the two mid-frequency producing drivers 20 and 20' (along dimension Z) from the exit of the waveguide 40 to the neck 50 at the entrance of the waveguide in the axial direction, the distance between the acoustic centers (Dimension M) of drivers 20 and 20' can be significantly reduced. As per Olson, this increases the maximum operating frequency of the frequency range associated with the mid-frequency producing drivers 20 and 20', thereby allowing this frequency to approach or surpass the lower end of first frequency range.

Accordingly, in one example implementation, mid-frequency producing drivers 20 and 20' may be positioned, to achieve a reduced distance therebetween, adjacent to neck 50. In one example implementation, in which mid-frequency producing drivers 20 and 20' each include a basket having an outer rim, the mid-frequency producing drivers 20 and 20' are positioned such that their respective outer rims are located adjacent to neck 50. It is noted that the sound chamber (wave shaping) devices considered here are designed for the purpose of integration into a line array loudspeaker enclosure, but can be generally applied to any loudspeaker enclosure.

Figure 4A:
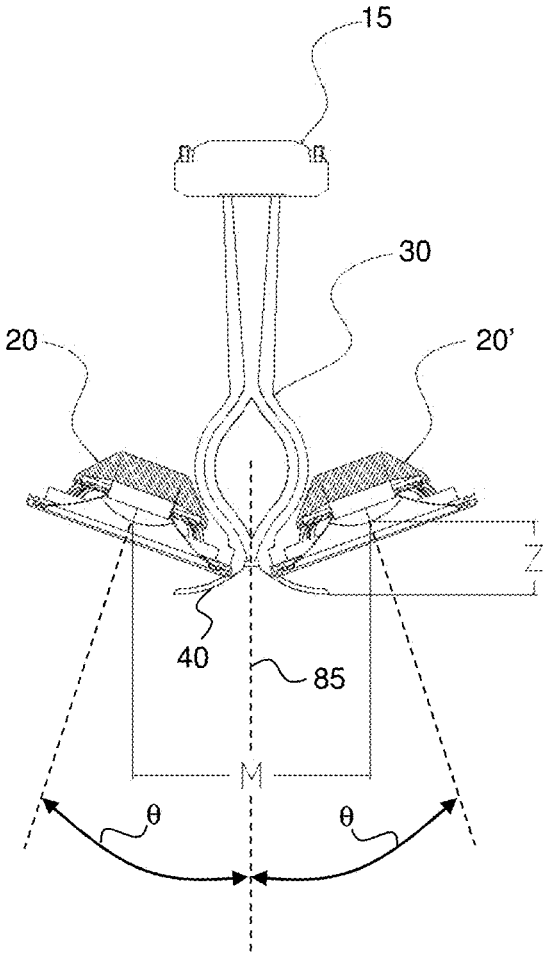
FIGS. 4A and 4B show top and front views of an example embodiment of a two-way loudspeaker including a high-frequency linear source coupled to a waveguide, where the lateral mid-frequency producing drivers are recessed behind the waveguide and outwardly angled.
Figure 4B:
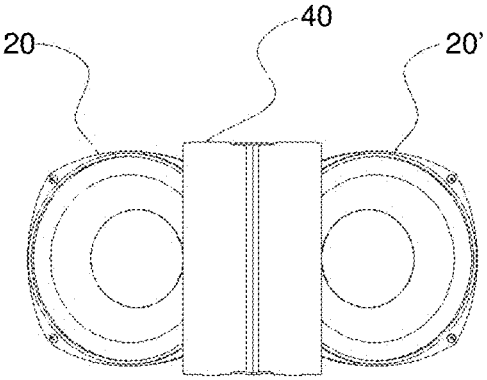

Referring now to FIGS. 4A and 4B, it will be apparent that the separation M between the centers of mid-frequency producing drivers 20 and 20' can be further reduced by rotating them outward at an angle θ relative to the plane 85 bisecting the output of waveguide 40. This raises the interference into a range that can be reproduced, and hence compensated for, by the high-frequency source. It will be understood that the angle, or a range of angles, that is suitable for further reducing the center-to-center distance M of mid-frequency producing drivers 20 and 20' will be dependent on the size and shape of mid-frequency drivers 20 and 20', waveguide 40, and sound chamber 30.

The rotation of mid-frequency producing drivers 20 and 20' may also be beneficial in improving the polar response of the loudspeaker output, by increasing the difference in sound level from one transducer with respect to the other at the cancellation points. The same applies where constructive interference occurs, resulting in a smoother polar response. It is also noted that reflections from the section of waveguide 40 that extends in front of the mid-frequency producing drivers 20 and 20' is also reduced by their rotation, further improving the uniformity of the sound field.

In cases where the size of the mid-frequency producing drivers 20 and 20' would preclude their placement according to the configuration shown in FIGS. 1A and 1B (due to the existence of interference below an intermediate frequency range at which the output from the high-frequency transducer can overlap in frequency with the output from mid-frequency producing drivers 20 and 20'), reducing the distance (dimension M) between the midrange transducers, for example, by means of physical placement adjacent to neck 50, and/or rotation, increases the upper frequency limit of the second frequency range (the frequency range associated with the mid-field producing drivers 20 and 20' while avoiding interference therebetween). The lower portion of the first frequency range (associated with the operation of the high-frequency source) thus can meet and overlap with the upper limit of the second frequency range. As noted above, having the first and second frequency ranges meet and overlap results in a third point source located midway between the two mid-frequency drivers 20 and 20' at the intersecting frequency range—effectively cutting the distance (Dimension M) in half and allowing the second frequency range to extend above its original upper limit without performance limitations associated with interference. Thus the lower end of the first frequency range will begin at the frequency with a wavelength approximately twice the length of distance M.

Referring now to FIGS. 3A-B and 4A-B, the recessing of the mid-frequency producing drivers 20 and 20' cause acoustic interference of the sound energy emitted by waveguide 40, due to the discontinuity in acoustic resistance of the wavefront on exiting the waveguide, which can lead to interference due to reflections off of the surfaces of mid-frequency producing drivers 20 and 20'. In other words, because the high-frequency source 10 will produce upper midrange frequencies to compensate for the distance between the mid-frequency producing drivers (as described above), a discontinuity in acoustic resistance will exist exiting waveguide 40 at those lower frequencies. This is because the waveguide is too small to control these frequencies. This effect would, in the absence of operation of the mid-frequency producing drivers 20 and 20', lead to another source of interference within the intermediate frequency range.

More specifically, the termination of waveguide 40 allows diffraction of acoustical energy from the edge of the waveguide. In other designs, the waveguide would be mounted in a flush baffle which would eliminate the diffraction or alternately would be mounted in free space where the diffracted energy would dissipate rearward from the edge of the waveguide. However, in the present example embodiments, the extension of the waveguide in front of the MF driver and mounting surfaces causes interference because the loudspeaker and mounting surfaces allow the high-frequency sound waves to reflect back toward the front of the enclosure and combine with the direct sound radiating from the waveguide. Since the combination of these two waves cannot be in phase, a cancellation occurs. One attempt to address this issue involves mounting the mid-frequency producing loudspeakers normal to the central axis of the loudspeaker enclosure, with the waveguide overlaid in front of the loudspeaker, such that the distance between the edge of the waveguide and the reflecting surface is minimized. However, while this practice results in minimizing the cancellation effect, it also raises the frequency of cancellation to a higher frequency.

This problem may be addressed or reduced in severity by employing signal processing to create an overlap of the frequency ranges as well as a delay between the sound energy emitted by the different transducer types (i.e. the mid-frequency generating drivers and the high-frequency source). The overlap of frequency is designed so all transducers/drivers can be time and level aligned to energize the area around the exit of the wave guide to a sound pressure level (SPL) and wavefront phase that will improve the discontinuities. This is possible when the interference is occurring in the intermediate frequency range where both the high-frequency source 10 and the mid-frequency producing drivers 20 and 20' are capable of effective acoustic output. It is also noted that the waveguide should be sufficiently wide such that it can control the highest frequency that the mid-frequency producing driver can reproduce (the ability of a waveguide to control the dispersion angle of the wavefront being emitted is proportional to wavelength). As noted above, the coverage of this frequency band by the mid-frequency producing drivers can be enabled by the reduced distance between their acoustic centers (Dimension M), and careful selection of the high-frequency and mid-frequency producing drivers to ensure they are able to produce the required first and second frequency ranges.

It is further noted that in embodiments in which the mid-frequency producing drivers are rotated relative to the central axis of the enclosure, the reflection distance is increased. In doing so, the interference frequency is lowered substantially, to a frequency that is within the range of frequencies that can be reproduced by the mid-frequency producing driver.

Figure 5:
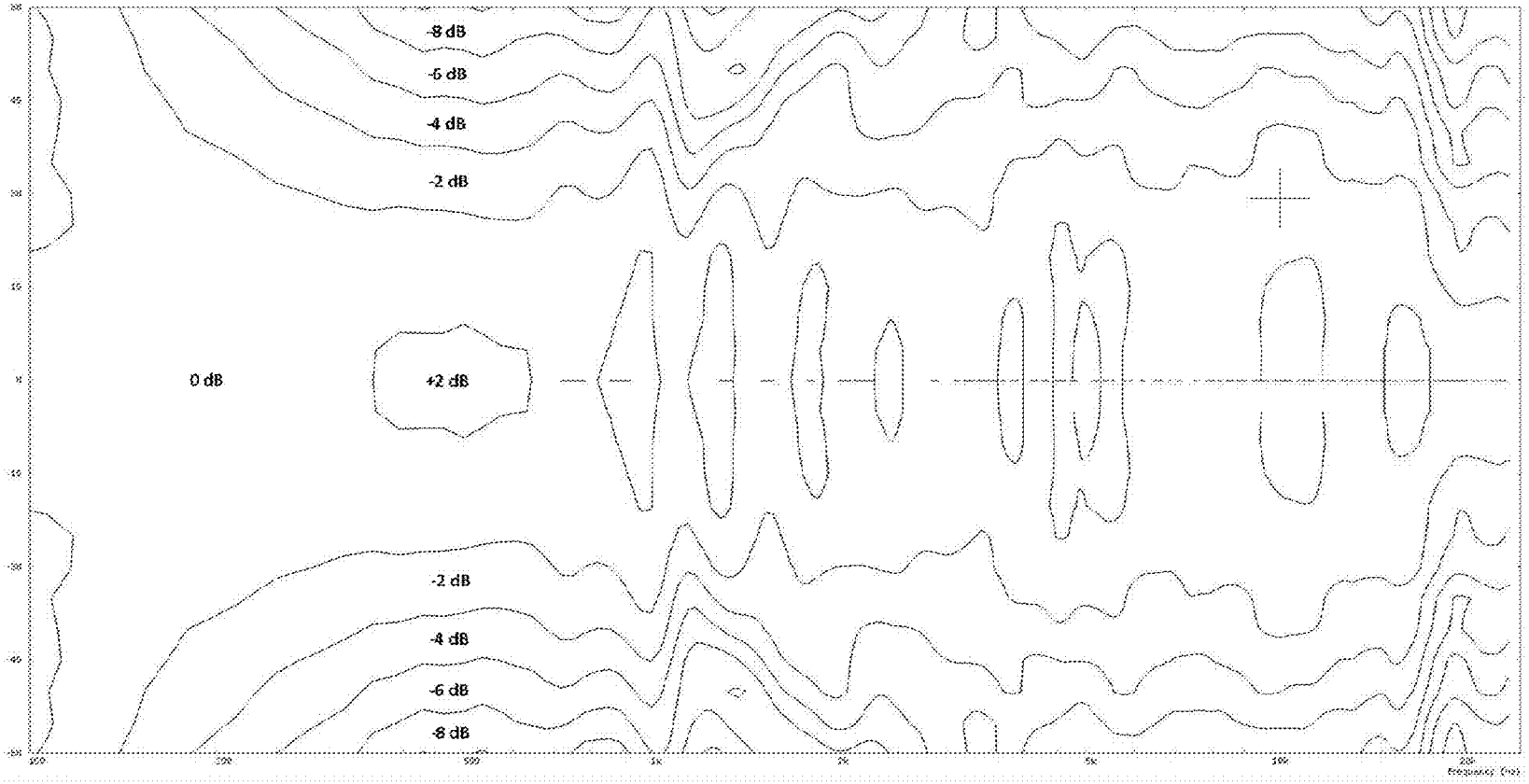
FIG. 5 is a contour plot of the angular sound field produced by an example implementation of a loudspeaker system.

FIG. 5 is a plot of a loudspeaker contour plot for an embodiment shown according to the configuration of FIGS. 4A and 4B, with a Z distance of 2.3" and an M distance of 10.5". The figure illustrates the relative homogeneity of the acoustic field that is produced by the loudspeaker system over a broad frequency range that includes low, mid, and high frequencies.

A conventional rule of thumb is that a waveguide designed for the purpose of controlling directivity of acoustical radiation should have a width, at its output, that is at least a half wavelength of the lowest design frequency. For example, a design with a lowest design frequency of 1132 Hz would yield, according to conventional design rules, a width (based on ½ wavelength) of 0.152M, below which, directivity control would become progressively less effective.

Another conventional rule of thumb is that the center-to-center distance between two drivers of a common frequency range should be less than approximately ½ a wavelength of the highest frequency to be reproduced. In the present example implementation, in which the waveguide width is 0.152 m, the center-to-center distance between two 10" divers closely spaced behind the waveguide (for example, as illustrated in FIGS. 4A and 4B), can be reduced to approximately 0.266 M. Conventional design rules would suggest that this driver spacing would yield an operating limit of 646 Hz for the mid-range frequencies.

This example shows that a design in which the placement of 10" mid-range producing drivers on either side of a waveguide, even when recessing the drivers behind the waveguide and angling the drivers outward, would yield an upper frequency limit for the mid-range producing drivers of 646 Hz, and a lower frequency limit for the high-frequency source of 1132 Hz. In other words, conventional design logic and teaching would lead to the conclusion that this design is inoperable, due to the large frequency gap between the upper limit of the mid-frequency producing drivers, and the lower frequency limit of the high-frequency source. Those skilled in the art would believe that the intermediate frequency range between these two limits should be avoided due to the presence of interference between the two mid-frequency producing drivers above 646 Hz, and the high-frequency interference arising from imperfect behaviour of the waveguide below 1132 Hz.

As described above, however, the present inventors have found that these interference effects can be avoided by selecting suitable crossover circuitry such that mid-frequency producing drivers and the high-frequency source emit sound energy within this intermediate frequency range. The high-frequency sound energy within the intermediate range acts as an additional mid-frequency source, effectively halving the distance between the drivers, and thereby avoiding effects of mutual interference. Furthermore, by controlling the delay between the high-frequency source and the low-frequency emitters to account for geometrical separation therebetween, the sound pressure level generated by the mid-frequency producing drivers in the intermediate range can avoid the interference effects caused by the imperfect waveguide outlet.

Therefore, in the present example embodiments, a suitable overlap can be achieved by extending the range of the frequencies emitted by the high-frequency source down to 646 Hz, and extending the range of frequencies emitted by the mid-frequency producing drivers up to 1132 Hz.

Signal processing is used to control the frequencies sent to the different driver groups and to ensure they are in phase. In some embodiments, due to the distance (dimension "Z") that the mid-frequency drivers are positioned from the output of the waveguide, a time delay is employed to ensure they remain in phase. The delay is configured so that the sound exiting the waveguide is in phase with the sound produced by the mid-frequency producing drivers arriving at the waveguide.

Figure 6:
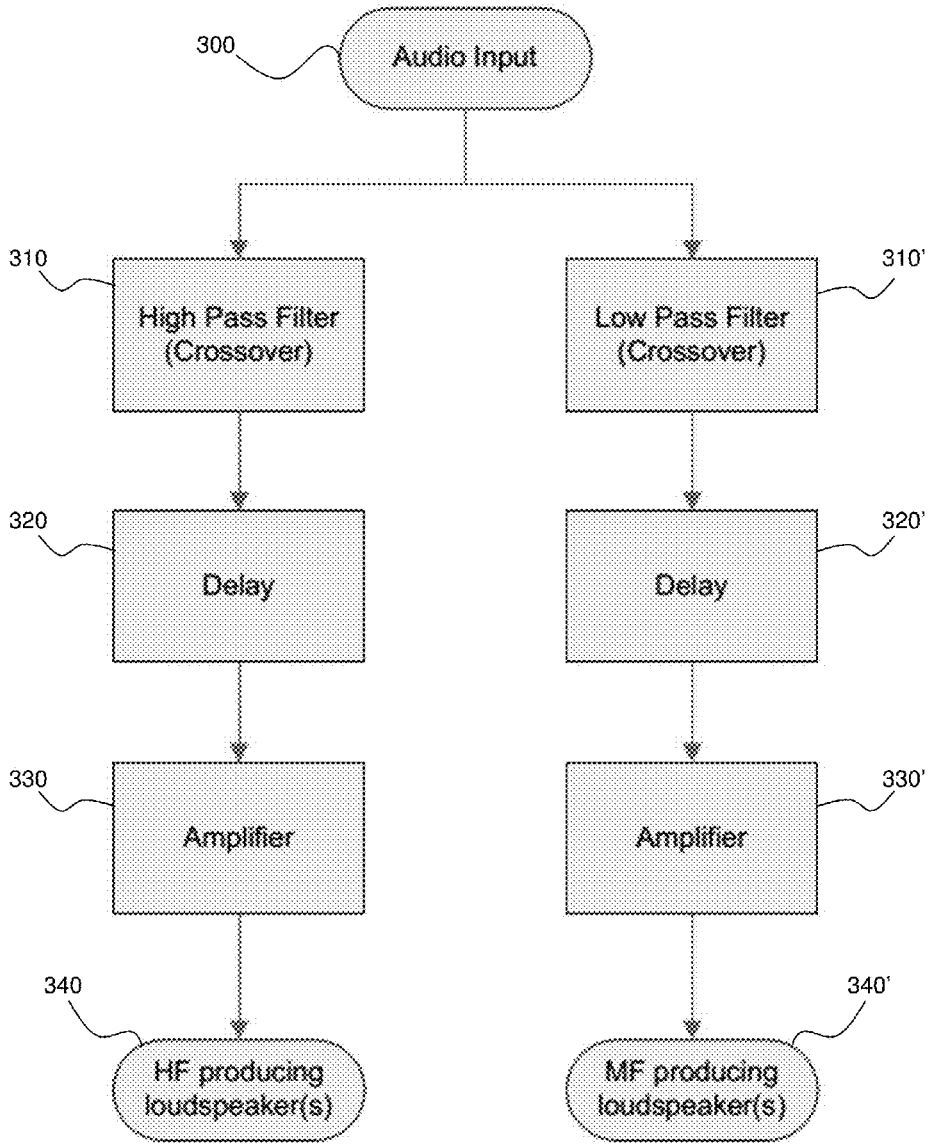
FIG. 6 illustrates an example implementation of signal processing circuitry.

FIG. 6 is block diagram showing an example configuration of the signal processing circuitry that may be employed according to various embodiments disclosed herein. The initial signal, provided at 300, is split and separately filtered by crossover circuitry including high pass filter 310 and low pass filter 310'. These filters generate the first and second signals that are provided to the high-frequency source 10 and mid-frequency generating drivers 20 and 20', respectively. As noted previously, example filter profiles are shown in FIG. 2. The high and low pass filters 310 and 320 may be controlled in order to achieve a suitable sound intensity, in the intermediate frequency region where the high-frequency source 10 and the mid-frequency producing drivers 20 and 20' overlap. For example, the filter profiles may be configured so that the net frequency response from both the high-frequency source 10 and the mid-frequency producing drivers 20 and 20' is flat or shaped according to a preselected net profile.

As shown in FIG. 6, the signal processing circuitry may also include delay control circuitry 320 and 320' (optionally a single delay control circuit may be provided along one of the two signal paths to control relative delay). As noted above, the delay circuitry may be employed, for example, in system configurations where the mid-frequency producing drivers 20 and 20' are recessed relative to the output of waveguide 40, in order to accommodate for the spatial offset and to avoid interference effects in the intermediate frequency range that would otherwise be caused by the spatial offset between the high-frequency source 10 and the mid-frequency producing drivers 20 and 20'.

Finally, the signal paths may be amplified by amplifiers 330 and 330' before the signals are provided to the high-frequency source 10 and the mid-frequency producing drivers 20 and 20' at 340 and 340', respectively.

Figure 7A:
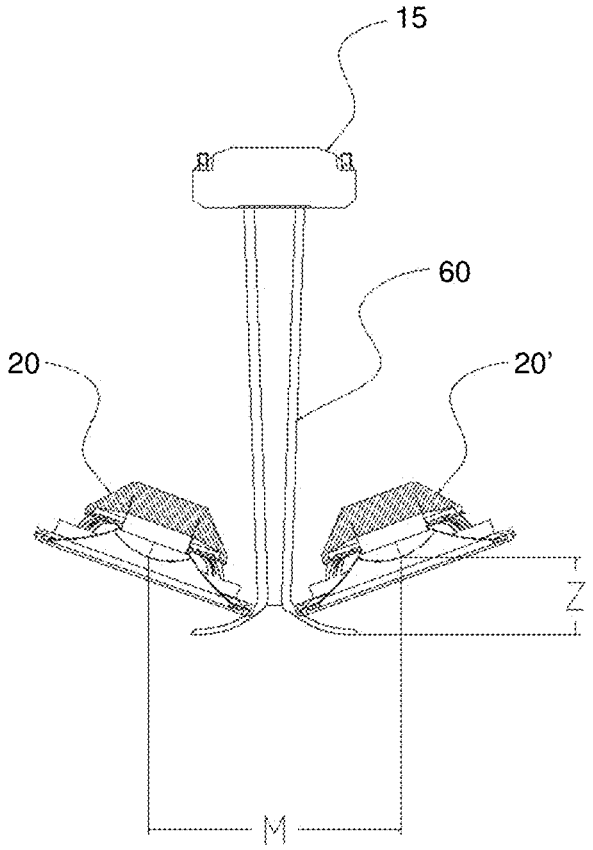
FIGS. 7A and 7B show top and front views of an example embodiment of a two-way loudspeaker including a high-frequency linear source that is formed from a diffraction horn, where the output of the diffraction horn is coupled to a waveguide.
Figure 7B:
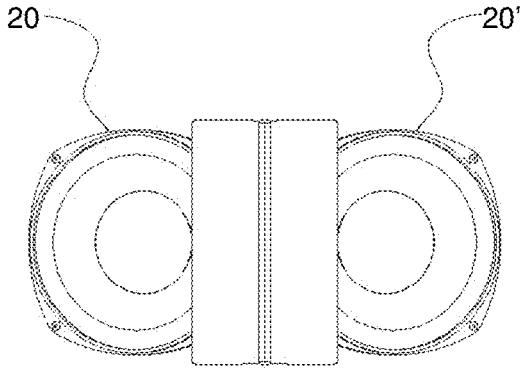
Figure 8A:
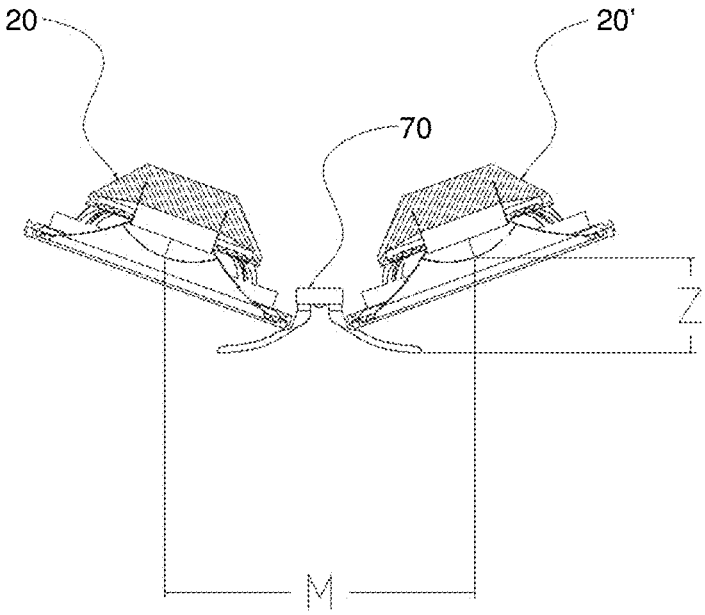
FIGS. 8A and 8B show top and front views of an example embodiment of a two-way loudspeaker including a high-frequency linear source that is formed from a linear array of tweeters that are coupled to a waveguide.
Figure 8B:
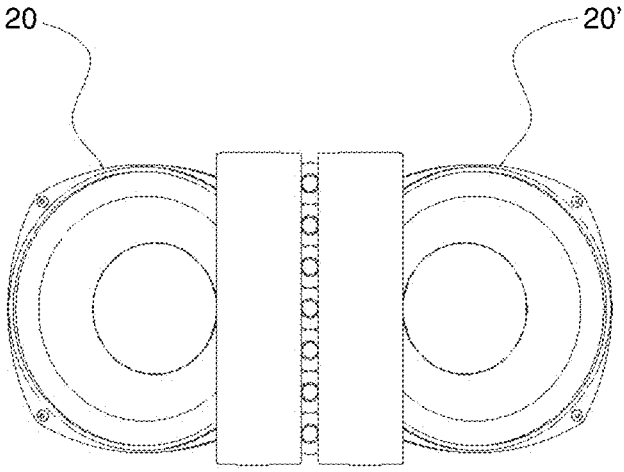

Although the preceding examples have been disclosed via illustrative embodiments involving a sound chamber, it will be understood that other alternative embodiments may be employed without requiring the presence of a sound chamber. For example, FIGS. 7A and 7B illustrate an alternative example embodiment in which the linear high-frequency source is replaced by a diffraction horn 60. FIGS. 8A and 8B illustrate another alternative example embodiment in which the linear high-frequency source is provided by a linear array of tweeters. 70.

Figure 9A:
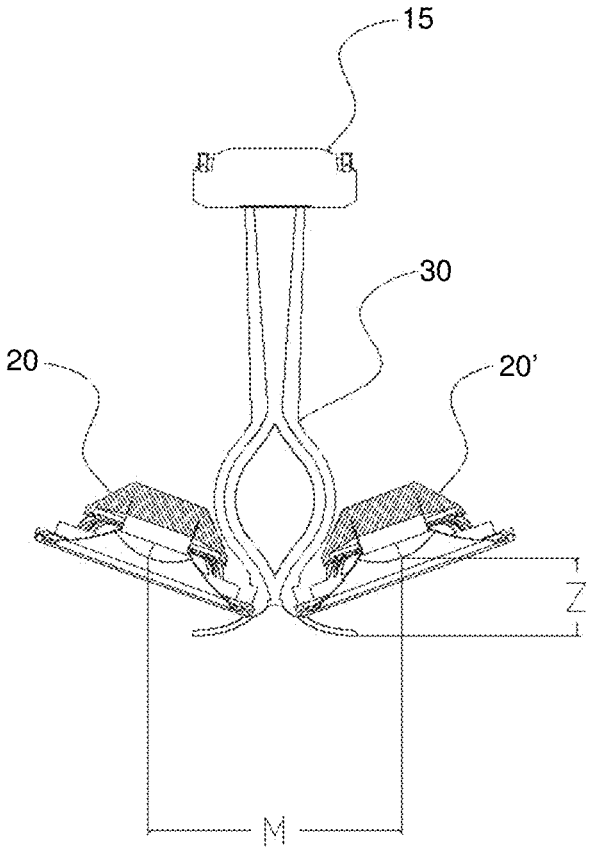
FIGS. 9A and 9B show top and front views of an example embodiment of a two-way loudspeaker including a high-frequency linear source coupled to a waveguide, where the lateral mid-frequency producing drivers are recessed behind the waveguide and outwardly angled, where two pairs of mid-frequency producing drivers are provided in a stacked configuration.
Figure 9B:
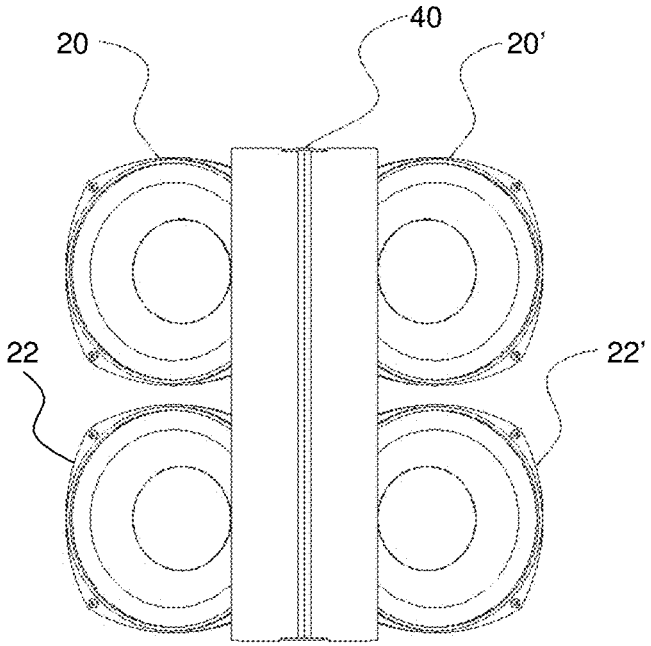
Figure 10A:
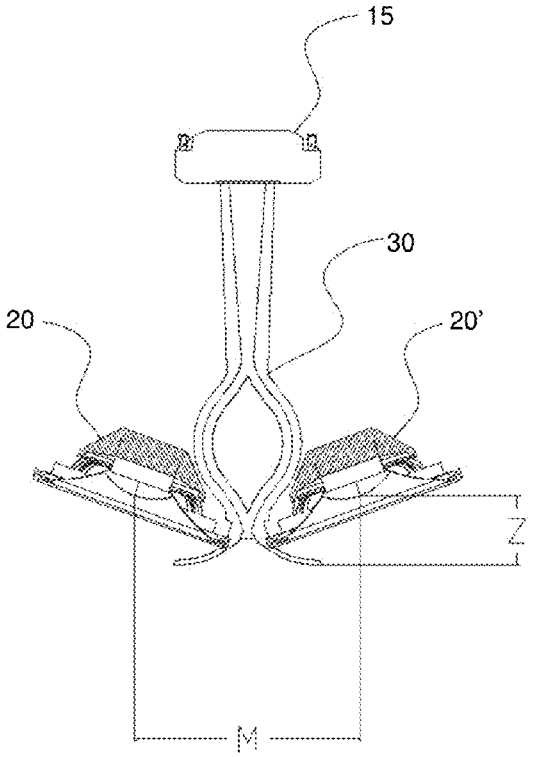
FIGS. 10A and 10B show top and front views of an example embodiment of a two-way loudspeaker including a high-frequency linear source coupled to a waveguide, where the lateral mid-frequency producing drivers are recessed behind the waveguide and outwardly angled, where two pairs of mid-frequency producing drivers are provided in a stacked configuration, and where each pair of mid-frequency producing drivers is interfaced with a dedicated sound chamber and waveguide.
Figure 10B:
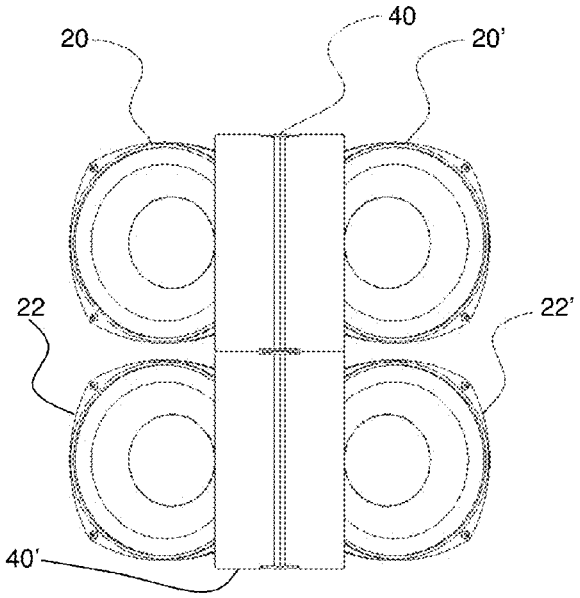

It is also noted that even though the preceding examples disclose illustrative embodiments involving a single pair of mid-frequency producing drivers 20 and 20', other embodiments may employ additional mid-frequency producing drivers, for example, in a stacked configuration. FIGS. 9A and 9B illustrate an example implementation involving two pairs of mid-frequency producing drivers 20, 20' and 22, 22'. While the example shown in FIGS. 9A and 9B employ a single sound chamber and a single waveguide 40, FIGS. 10A and 10B illustrate an alternative example implementation in which two sound chambers (not shown) and two waveguides 40 and 40' are provided (one for each stacked pair).

While the preceding example embodiments have addressed two-way systems, it will be understood that the embodiments provided herein may be extended to three-way systems. A three-way loudspeaker system is based on similar principles to that of a two-way system, utilizing added mid-range transducers, which can improve system performance provided that the physical relationship between the transducers does not cause destructive acoustical interference. A three-way system generally includes low-frequency and medium-frequency drivers that are often of the direct radiating, dynamic loudspeaker type. In some examples, these drivers may be placed in a structure that acoustically loads the device so that it may be referred to as horn loaded, band pass, or other.

Whether a two-way or a three-way loudspeaker system of this type is considered, the transition from the mid frequency producing transducer into the high frequency transducer is generally limited to an approximate range from 700 Hz to 2,000 Hz. As described above, in the case of a two-way system, the "low frequency" transducer is employed to supply the mid-range frequencies (such a transducer has been referred to as a "mid-frequency producing driver" in this disclosure). In the case of a three-way system, a dedicated mid-range transducer provides this frequency range. In many cases, the mid-range transducer of a larger system might be similar in size to the low frequency transducer of a small system. As an example, there are two-way systems based on 6" low-frequency drivers, and there are large three-way systems with 6" mid-frequency drivers.

Figure 11A:
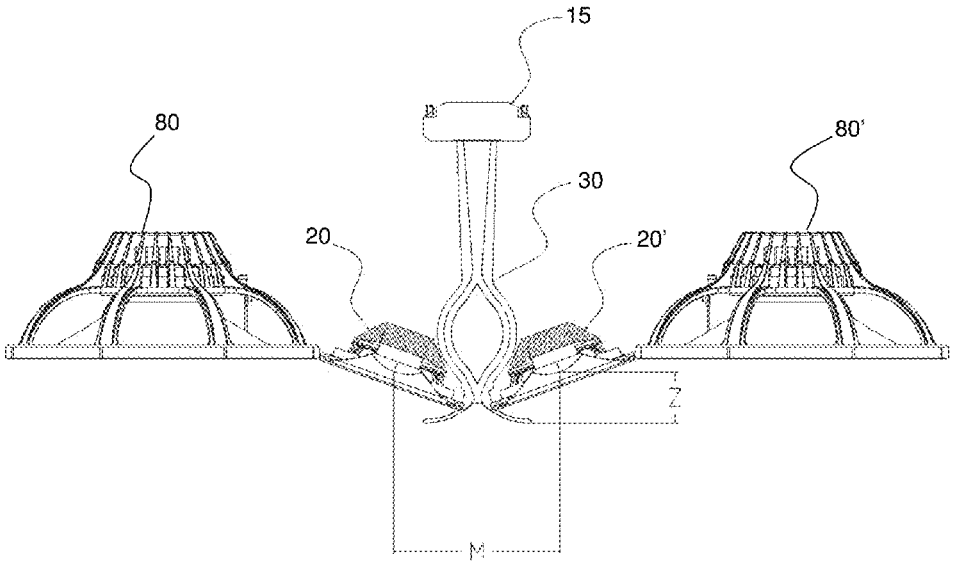
FIGS. 11A and 11B show top and front views of an example three-way system configuration.
Figure 11B:
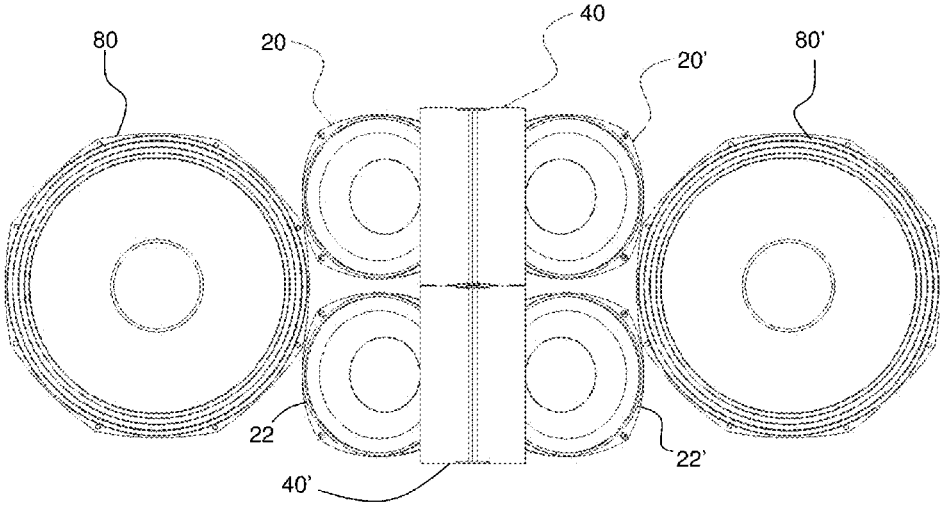

FIGS. 11A and 11B illustrate an example embodiment in which a two-way example embodiment is extended to the case of a three-way system. Two stacked central high frequency linear sources are provided, each having dedicated high-frequency source 15, sound chamber 30, and waveguide (shown as waveguides 40 and 40' in FIG. 11B). Two stacked pairs of mid-frequency drivers 20,20' and 22,22' are provided on either side of the waveguides, with the mid-frequency drivers recessed and optionally angled, as described in the previous embodiments, where the crossovers are configured such that an overlap in frequency exists between the output range of the mid-frequency drivers and the high-frequency sources, for reducing the forms of interference described above. This configurations enables, for example, the use of larger mid-frequency drivers than that which would be achieved using a conventional design without frequency overlap.

An example implementation of a three-way system is now provided, which has an initial configuration that is based on the previously mentioned example two-way system. The waveguide is designed for a lower frequency limit of 1132 Hz, resulting in an output width of 0.152 m. The mid-frequency producing drivers are the placed at neck, resulting in a distance between acoustic centers of approximately 0.266 m—yielding an upper operating limit of 646 Hz according to conventional design rules. Two additional low-frequency drivers are symmetrically added on either side of the mid-frequency producing drivers. As described above, crossover circuitry is selected to produce a frequency overlap between the mid-frequency producing drivers and the high-frequency source, such that interference effects arising within an intermediate frequency range (that is addressable by both the high-frequency source and the mid-frequency drivers) can be reduced or suppressed.

Due to the larger diameter of the low-frequency drivers, the linear high-frequency source would be increased in height to extend as close as possible to the top and bottom surfaces of the cabinet. This can be done either by using one or more waveguides.

In the present example embodiment, the distance between the acoustic centers of the low-frequency drivers is smaller than usual due to the placement of the mid-frequency producing drivers closer together. The distance between the acoustic centers of the low-frequency drivers is thus the distance between the outside edge of the mid-frequency producing drivers plus the distance from the outer edge of the low-frequency driver to its acoustic center, plus any additional clearance required. The previously determined distance between the mid-frequency producing drivers of 0.266 m is used in the present example to calculate that their outer edges are approximately 0.266 m+2×0.127 m=0.520 m apart. If two 15 inch (0.381 m) low-frequency transducers are used, their acoustic centers will be approximately 0.520 m+2×(0.381 m/2)=0.901 m apart.

Using Olson's formula here, one finds that the maximum operating frequency is 344 m/s/(2×0.901 m)=190 Hz, and thus the crossover between the low-frequency and mid-frequency producing drivers is approximately 190 Hz or lower.

Figure 12A:
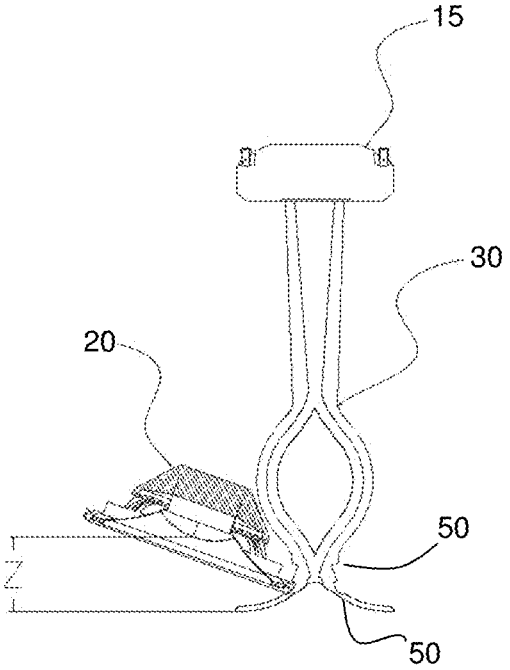
FIGS. 12A and 12B illustrate an example embodiment involving an asymmetrical configuration including a high-frequency linear source coupled to a waveguide, and a mid-frequency producing driver recessed behind the waveguide and outwardly angled.
Figure 12B:
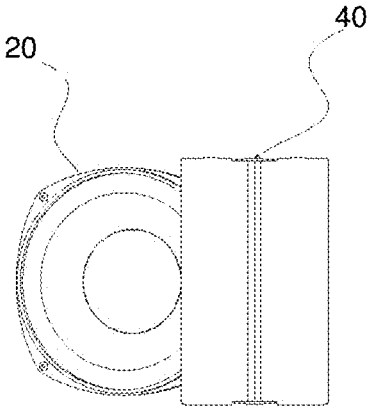

The preceding embodiments have illustrated symmetric loudspeaker configurations, in which a central high-frequency source is symmetrically flanked by one or more pairs of mid-frequency producing drivers. However, it is to be understood that some of the aforementioned embodiments may be extended to asymmetrical configurations. FIGS. 12A and 12B illustrate an example of such an asymmetric configuration, in which a single mid-frequency producing driver 20 is recessed (by distance Z) behind the output of waveguide 40. Driver 20 is positioned adjacent to neck 50 at the output of sound chamber 30, and is outwardly oriented, such that frequencies associated with interference caused by diffraction from the output of waveguide and reflections from driver 20, lie within an intermediate frequency range that is common to the operable frequency range of both high-frequency source 15 and driver 20, thereby enabling its suppression by the output of driver 20 (with a suitable delay generated by signal processing circuitry).

It will be understood that many other variations of the preceding embodiments may be practiced (such as using more than two pairs of mid-frequency producing drivers, more than two sound chambers, or more than two waveguides, and various combinations of additional low-frequency drivers as per a three-way system) without departing from the intended scope of the present disclosure.

The loudspeaker systems and configurations described herein may be assembled in an enclosure such as a wooden, plastic or composite loudspeaker enclosure, which may serve as a substrate for mounting transducers, sound chambers, electrical and electronic devices and rigging hardware. The loudspeaker enclosure generally has a central axis, a top, a bottom, two end panels, a back and a front baffle or transducer mounting surface. The loudspeaker enclosure may also provide a volume of air to facilitate the mounting and tuning of direct radiating sealed or vented loudspeakers or may provide other methods of acoustical loading. Non-limiting examples of loudspeaker enclosures for forming an array element are provided in United States Patent Application No. US 20130301862, titled "Loudspeaker Array Element".

A loudspeaker assembly may include drivers (audio transducers), enclosures which define volumes of air for related low and mid-frequency transducers, horns or wave shaping sound chambers and related transducers, rigging hardware, amplifiers, heat sinks, digital signal processing hardware or networking hardware or some combination of these components. For example, in both commercial and home systems the vast majority of amplifiers have been separate from the loudspeaker, although in the past decade it is becoming more common to for the power amplifier to be mounted within the loudspeaker assembly: These assemblies may be configured as array elements that are joined together to form a line array of a desired geometry, functionality and performance.

Figure 13A:
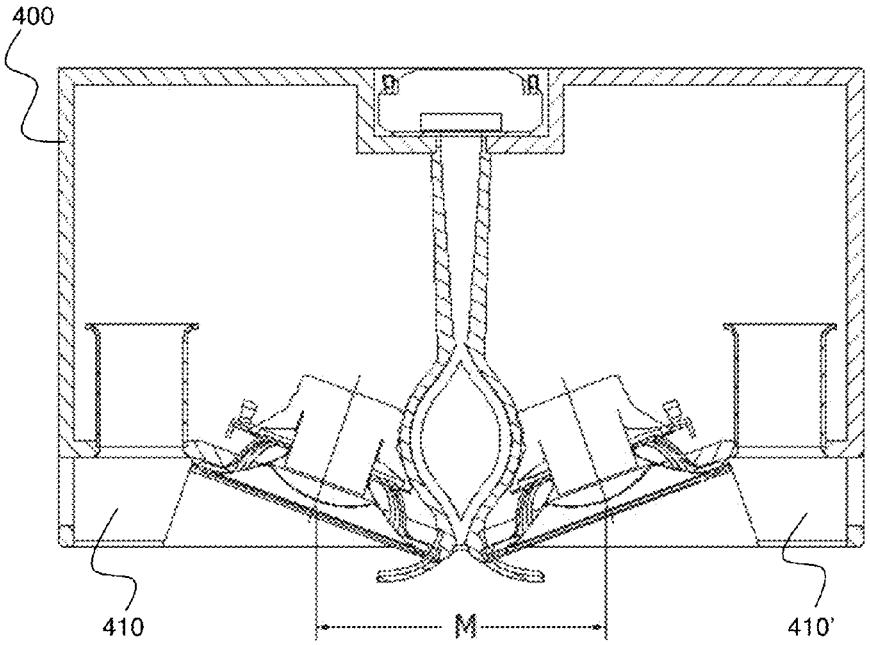
FIGS. 13A-C illustrate a loudspeaker assembly including the components shown in FIGS. 4A-B.
Figure 13B:
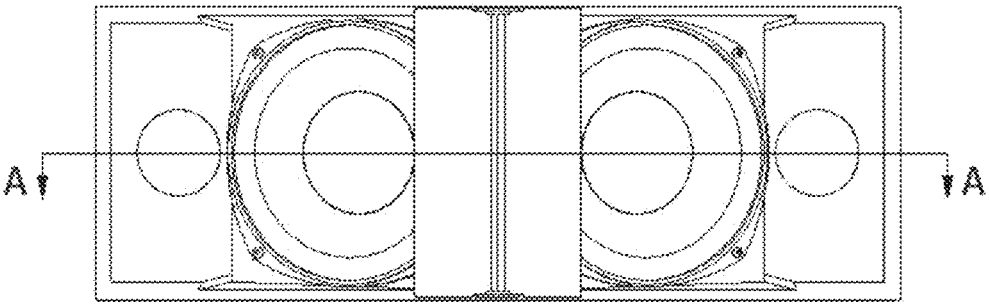
Figure 13C:
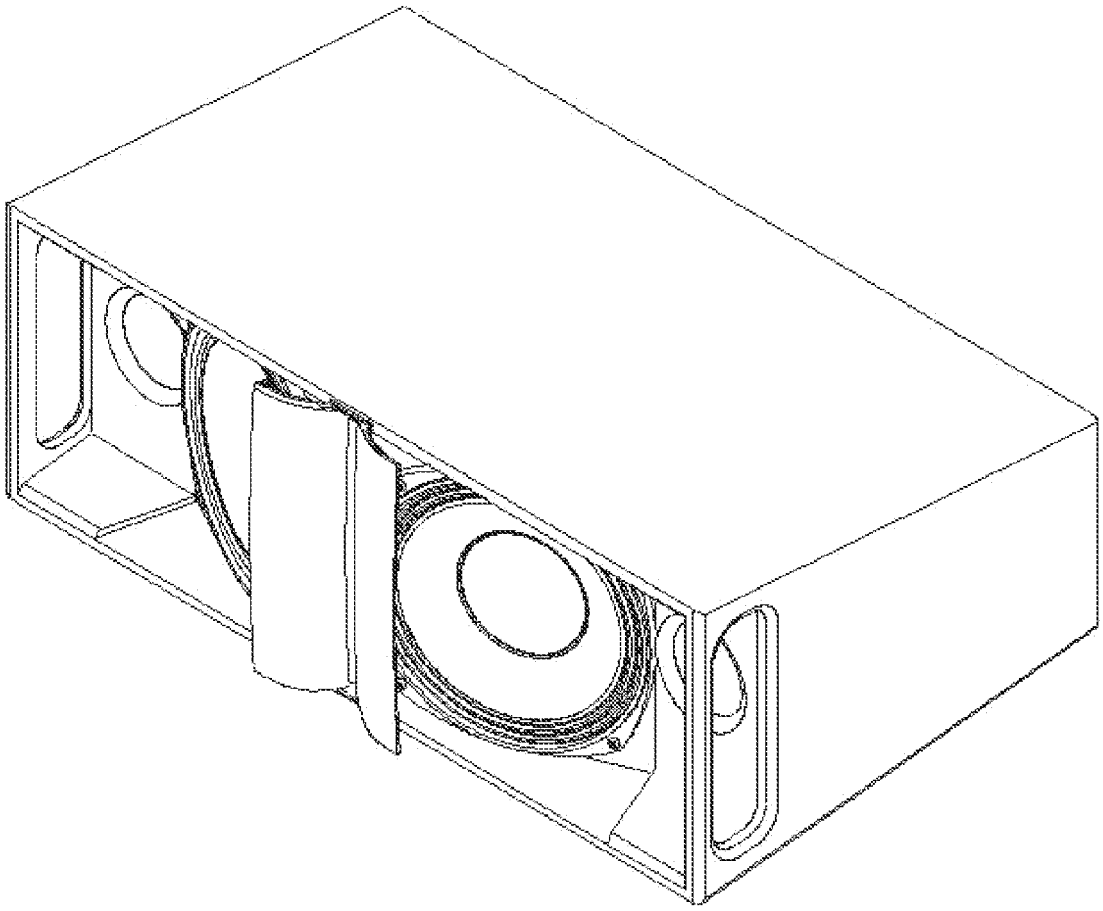

FIGS. 13A-C illustrate the speaker configuration shown in FIGS. 4A-B housed within a loudspeaker enclosure 400, including vents 410 and 410'.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

Therefore what is claimed is:

1. A loudspeaker system comprising:

a linear acoustic source;

a waveguide configured to radiate the sound energy from said linear acoustic source, said waveguide having a proximal aperture for receiving the sound energy and a distal aperture for radiating the sound energy, and a surface therebetween for controlling horizontal dispersion of the sound energy emitted therefrom;

a first driver and a second driver provided on opposing sides of a central plane bisecting said distal aperture of said waveguide;

signal processing circuitry comprising crossover circuitry that is configured to split an input signal into a first signal within a first frequency range and a second signal within a second frequency range, wherein the second frequency range is lower than the first frequency range and overlaps with the first frequency range over an intermediate frequency range residing between the lower −6 dB frequency of the first frequency range and the upper −6 dB frequency of the second frequency range, and wherein said crossover circuitry is in electrical communication with said linear acoustic source and said first driver and said second driver for providing the first signal to said linear acoustic source, and providing the second signal to said first driver and said second driver;

wherein said first driver and said second driver are provided with a relative spacing such that acoustic interference between said first driver and said second driver occurs within the intermediate frequency range, such that the acoustic interference is suppressed at least in part within the intermediate frequency range by the sound energy emitted by the waveguide.

2. The loudspeaker system according to claim 1 wherein said first driver and said second driver are recessed behind said distal aperture of said waveguide, such that a minimum distance between said first driver and said second driver is less than the width of said distal aperture; and wherein said first driver and said second driver are positioned relative to said distal aperture of said waveguide such that in the absence of operation of said first driver and said second driver, a portion of the sound energy that is emitted from said waveguide is reflected by said first driver and said second driver, and produces additional acoustic interference that lies within the intermediate frequency range;

wherein said signal processing circuitry further comprises delay circuitry to control a time delay between the first signal and the second signal to reduce the additional acoustic interference due to the pressure caused by the output of the first driver and the second driver.

3. The loudspeaker system according to claim 1 wherein said first driver and said second driver are angled outwardly relative to said central plane.

4. The loudspeaker system according to claim 3 wherein said linear acoustic source comprises a linear array of tweeters.

5. The loudspeaker system according to claim 3 further comprising:

a sound chamber having an inlet positioned to receive the sound energy from said linear acoustic source and to direct the sound energy to an inlet of said waveguide;

wherein a neck is defined between an outlet of said sound chamber and said inlet of said waveguide; and wherein said first driver and said second driver are positioned such that a distal portion thereof is position adjacent to said neck.

6. The loudspeaker system according to claim 5 wherein said first driver and said second driver each comprise a basket having an outer rim, and wherein said first driver and said second driver are each positioned such that said outer rim thereof is located adjacent to said neck.

7. The loudspeaker system according to claim 5 wherein said linear acoustic source is produced by a horn driver.

8. The loudspeaker system according to claim 7 wherein said horn driver comprises a compression driver acoustically coupled to a horn.

9. The loudspeaker system according to claim 7 wherein said horn driver comprises a diffraction horn.

10. The loudspeaker system according to claim 1 further comprising:

a third driver provided adjacent to said first driver; and a fourth driver provided adjacent to said second driver;

wherein said crossover circuitry is also configured to split the input signal into a third signal within a third frequency range, wherein the third frequency range is lower than the second frequency range, and wherein said crossover circuitry is in electrical communication with said third driver and said fourth driver for providing said third signal to said third driver and said fourth driver; and wherein said third frequency range is selected to avoid acoustic interference between said third driver and said fourth driver.

11. The loudspeaker system according to claim 1 wherein the diameter of said first driver or said second driver is greater than or equal to approximately 8 inches.

12. The loudspeaker system according to claim 11 wherein a center-to-center separation of said first driver and said second driver is less than 16".

13. The loudspeaker system according to claim 1 wherein the diameter of said first driver or said second driver is greater than or equal to approximately 10 inches.

14. The loudspeaker system according to claim 13 wherein the center-to-center separation of said first driver and said second driver is less than 20 inches.

15. The loudspeaker system according to claim 1 wherein said intermediate frequency range, as measured based on a −6 dB bandwidth, is at least approximately 200 Hz.

16. The loudspeaker system according to claim 1 wherein said intermediate frequency range, as measured based on a −6 dB bandwidth, is at least approximately 400 Hz.

17. The loudspeaker system according to claim 1 wherein said crossover circuitry is configured to maintain a preselected frequency response within the intermediate frequency range.

18. An asymmetric loudspeaker assembly comprising:

a linear acoustic source configured to output sound energy within a first frequency range;

a waveguide configured to receive the sound energy from said linear acoustic source, said waveguide having a distal aperture for controlling horizontal dispersion of the sound energy emitted therefrom;

a driver provided on one side of a central plane bisecting said distal aperture of said waveguide, wherein the other side of the central plane is absent of a second driver;

wherein said driver is configured to operate within a second frequency range that is lower than the first frequency range and overlaps with the first frequency range over an intermediate frequency range; and wherein said driver is recessed behind said distal aperture of said waveguide; and wherein said driver is angled outwardly relative to said central plane.

19. The loudspeaker according to claim 18 wherein said driver is positioned relative to said distal aperture of said waveguide such that in the absence of operation of the driver, a portion of the sound energy that is emitted from said waveguide is reflected by said driver and, and produces additional acoustic interference that lies within the intermediate frequency range.

20. A loudspeaker system comprising:

a loudspeaker assembly according to claim 19; and crossover circuitry configured to split an input signal into a first signal within the first frequency range and a second signal within the second frequency range; and signal processing circuitry configured to control a time delay between the first signal and the second signal to reduce the additional acoustic interference due to pressure caused by the output of the driver.

21. A loudspeaker assembly comprising:

a linear acoustic source configured to output sound energy within a first frequency range;

a waveguide configured to receive the sound energy from said linear acoustic source, said waveguide having a distal aperture for controlling horizontal dispersion of the sound energy emitted therefrom;

a first driver and a second driver provided on opposing sides of a central plane bisecting said distal aperture of said waveguide;

wherein said first driver and said second driver are configured to operate within a second frequency range that is lower than the first frequency range and overlaps with the first frequency range over an intermediate frequency range;

wherein said first driver and said second driver are provided with a relative spacing such that acoustic interference between said first driver and said second driver occurs within the first frequency range;

wherein said first driver and said second driver are recessed behind said distal aperture of said waveguide; and wherein said first driver and said second driver are angled outwardly relative to said central plane.

* * * * *